US008151420B2

(12) United States Patent
Randall

(10) Patent No.: US 8,151,420 B2
(45) Date of Patent: Apr. 10, 2012

(54) FUNERAL VASE STATUES

(76) Inventor: Randy B. Randall, Indian Head, MD (US)

( * ) Notice: Subject to any disclaimer, the term of this patent is extended or adjusted under 35 U.S.C. 154(b) by 40 days.

(21) Appl. No.: 12/656,904

(22) Filed: Feb. 18, 2010

(65) Prior Publication Data

US 2010/0287750 A1 Nov. 18, 2010

Related U.S. Application Data

(60) Provisional application No. 61/213,160, filed on May 12, 2009.

(51) Int. Cl.
*A61G 17/00* (2006.01)

(52) U.S. Cl. ..... 27/1; 47/41.1; 52/103

(58) Field of Classification Search ..... 27/1; D99/19; 40/124.5, 606.1, 618; 47/41.1, 41.01; 52/103–104; 428/34.1, 542.4, 3; 206/423
See application file for complete search history.

(56) References Cited

U.S. PATENT DOCUMENTS

| | | | | |
|---|---|---|---|---|
| 1,539,153 | A * | 5/1925 | Bennett | 47/41.11 |
| 1,645,577 | A * | 10/1927 | Bennett | 47/41.13 |
| 2,235,617 | A | 3/1941 | Klinzing | |
| 2,488,924 | A * | 11/1949 | Meierjohan et al. | 47/41.1 |
| D186,236 | S | 9/1959 | O'Brien et al. | |
| 3,001,326 | A | 9/1961 | O'Brien et al. | |
| 3,229,948 | A | 1/1966 | King | |
| 3,328,914 | A | 7/1967 | Newman | |
| 4,980,807 | A * | 12/1990 | Von Kohorn | 362/122 |
| 5,379,499 | A | 1/1995 | Jackson | |
| 5,732,830 | A | 3/1998 | Harrington | |
| 6,092,330 | A * | 7/2000 | Pratt | 47/41.1 |
| 6,200,507 | B1 | 3/2001 | Dennis | |
| 6,295,705 | B1 | 10/2001 | Gersten | |
| 7,059,082 | B2 * | 6/2006 | Barlow | 47/41.01 |
| 7,234,271 | B1 * | 6/2007 | Tolley et al. | 47/29.5 |
| 7,308,740 | B2 | 12/2007 | Roberts | |
| 7,370,394 | B1 | 5/2008 | Juneau | |
| 7,448,161 | B2 * | 11/2008 | Taylor | 47/41.1 |
| 7,635,196 | B2 * | 12/2009 | Monahan | 362/183 |
| 7,793,462 | B1 * | 9/2010 | Sherette | 47/41.1 |
| 2003/0115728 | A1 | 6/2003 | Robert | |

(Continued)

FOREIGN PATENT DOCUMENTS

| | | | |
|---|---|---|---|
| BE | 1016376 | A6 | 9/2006 |
| DE | 3328106 | A1 | 2/1985 |
| GB | 2 383 350 | A | 6/2003 |

OTHER PUBLICATIONS

Memorial urns and tributes "on sale" by memorial-urns.com, 3 pages printed Oct. 28, 2008. http://www.memorial-urns.com/store/home.php?printable=Y&cat=35&page=1.

Monuments with vases "on sale" by memorial-urns.com, 4 pages printed Oct. 28, 2008. http://www.burlesonmonuments.com/.

*Primary Examiner* — William L. Miller
(74) *Attorney, Agent, or Firm* — Richard C. Litman

(57) ABSTRACT

The funeral vase statues include pre-cast statues or figurines and vases, the statues or figurines being interchangeably attached to or supported by the vases. The statues or figurines are lightweight and can be installed or removed easily from the vases. The vases may have bottom fastening members for attachment to a monument stone equipped with a complementary fastening system. Alternatively, the bottom fastening members may be directly attached to bottom of the statues or figurines so that the statues or figurines may be securely attached to the monument stone directly without a vase. A variety of statue/figurine designs are provided, and may include cultural and/or religious figures, symbols, and the like.

7 Claims, 5 Drawing Sheets

U.S. PATENT DOCUMENTS

2005/0120525 A1 6/2005 Heil et al.
2005/0246951 A1* 11/2005 Taylor ..... 47/41.1
2007/0084027 A1 4/2007 Walczak
2008/0028692 A1* 2/2008 Segura ..... 52/103

* cited by examiner

FUNERAL VASE STATUES

CROSS-REFERENCE TO RELATED APPLICATION

This application claims the benefit of U.S. Provisional Patent Application Ser. No. 61/213,160, filed May 12, 2009.

BACKGROUND OF THE INVENTION

1. Field of the Invention

The present invention relates generally to memorial figurines, and more particularly to funeral vase statues that provide pre-cast statues or figurines that can be interchangeably installed into a vase and held by fasteners.

2. Description of the Related Art

Monuments for gravesites are ubiquitous. Often times these monuments are in the form of statues. These statues or other type monuments are most likely of a permanent, immutable nature. However, when a family member goes to a gravesite to pay tribute to the deceased on a particular day of remembrance or holiday, it would be desirable to be able to modify the gravesite monument or statue to be in keeping with day of remembrance or holiday. For example, it would be desirable to modify the monument for an event holiday such as Christmas, Easter, a family member's birthday, the deceased's birthday, and the like.

Thus, funeral vase statues solving the aforementioned problems are desired.

SUMMARY OF THE INVENTION

The funeral vase statues include pre-cast statues or figurines and vases, the statues or figurines being interchangeably attached to or secured in the vases. The statues or figurines are lightweight and can be installed or removed easily from the vases. The vases may have bottom fastening members for attachment to a monument stone equipped with a complementary fastening system. Alternatively, the bottom fastening members may be directly attached to bottom of the statues or figurines so that the statues or figurines may be securely attached to the monument stone directly without a vase. A variety of statue/figurine designs are provided, and may include cultural and/or religious figures, symbols, and the like.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
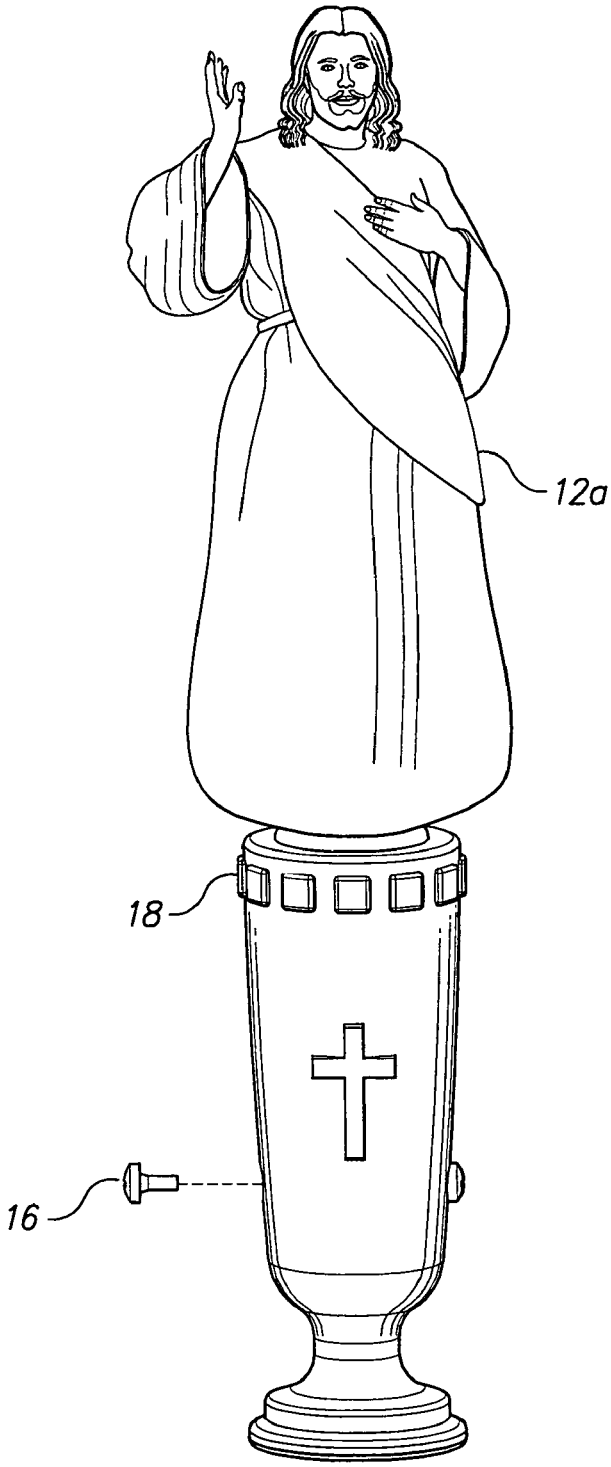
FIG. 1 is an environmental, perspective view of one of the funeral vase statues according to the present invention.
Figure 2:
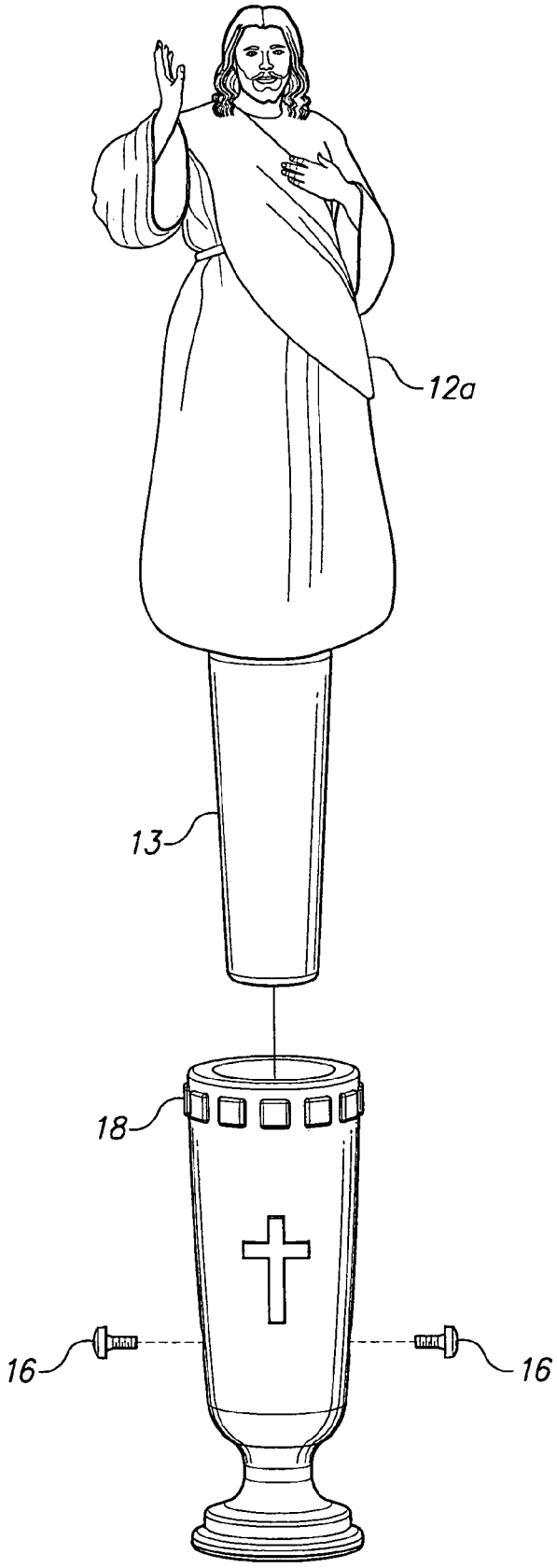
FIG. 2 is an exploded, perspective view of one of the funeral vase statues according to the present invention.
Figure 3:
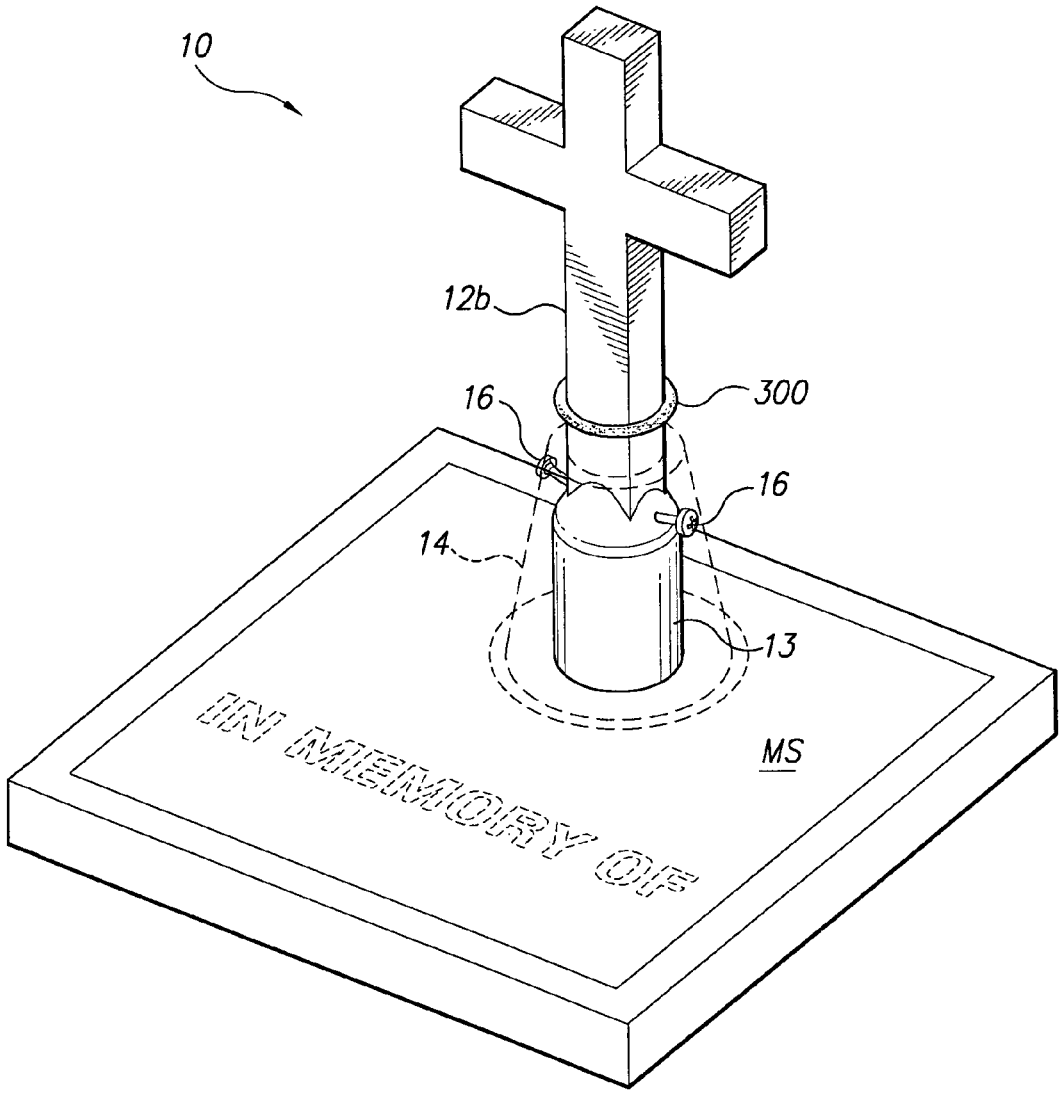
FIG. 3 is a perspective view of one of the funeral vase statues or figurines according to the present invention.

Referring to FIGS. 1-3, in one embodiment, the funeral vase statues 10 are pre-cast statues 12*a* or figurines 12*b* and at least one vase 14, the statues 12*a* and figurines 12*b* being interchangeably attached to or supported by the vase 14. The statue 12*a* or figurine 12*b* has a mounting cylinder 13 extending from its base that is dimensioned and configured to fit into the vase 14. Although the mounting cylinder 13 may extend far enough into the vase 14 to support the statue 12*a* or figurine 12*b* without further assistance, fasteners, such as setscrews 16, may be threaded through the vase 14 into internally threaded bores in the mounting cylinder 13 to secure the statue or figurine to the vase 14 so that the statue or figurine does not rotate. The statues 12*a* or figurines 12*b* are lightweight and can be installed or removed easily from the vases 14. This enables the statues 12*a* or figurines 12*b* to be easily interchanged to adorn the gravesite, as desired.

Figure 4:
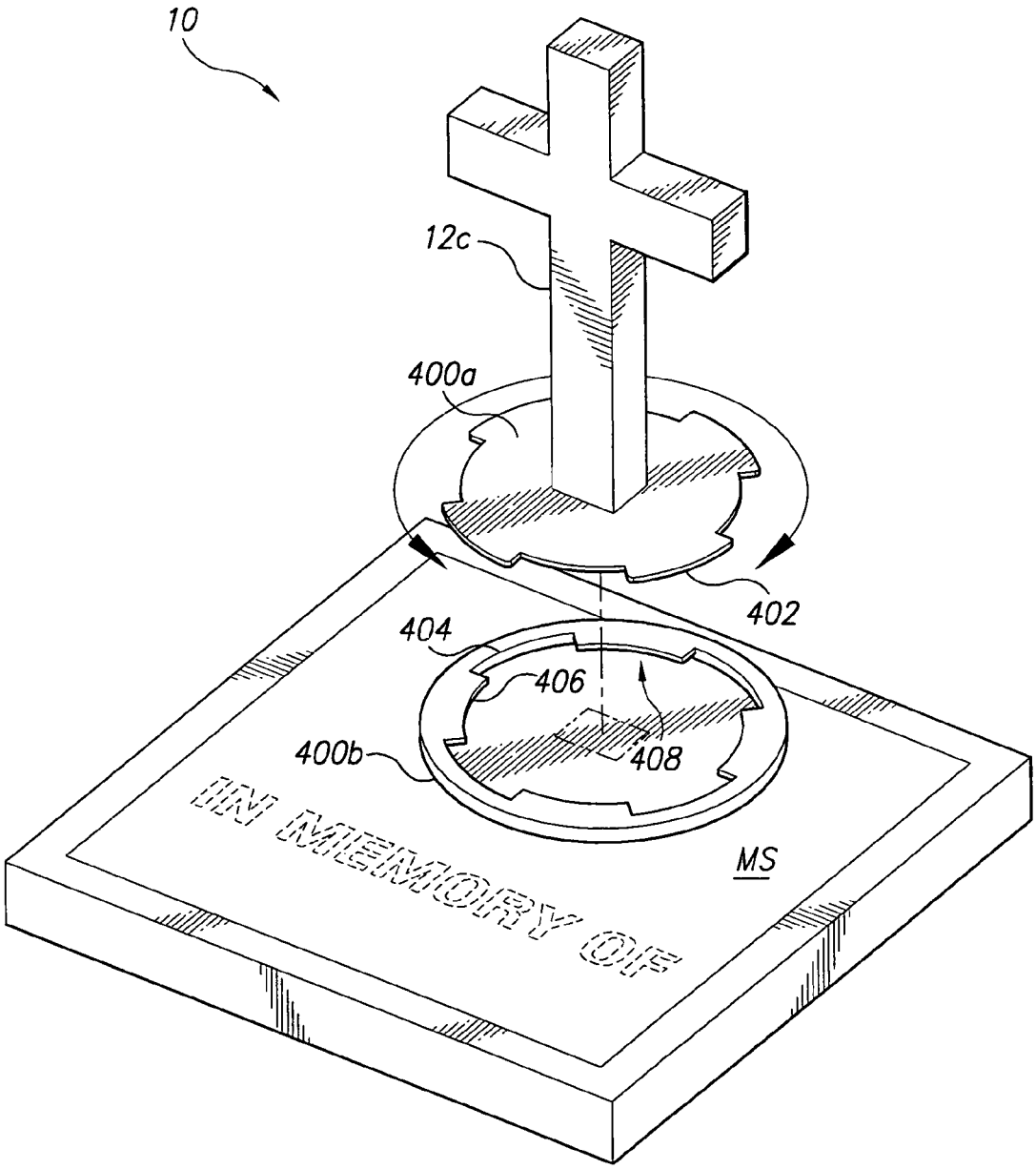
FIG. 4 is an exploded, perspective view of one of the funeral vase statues according to the present invention having a monument stone mounting plate.
Figure 5:
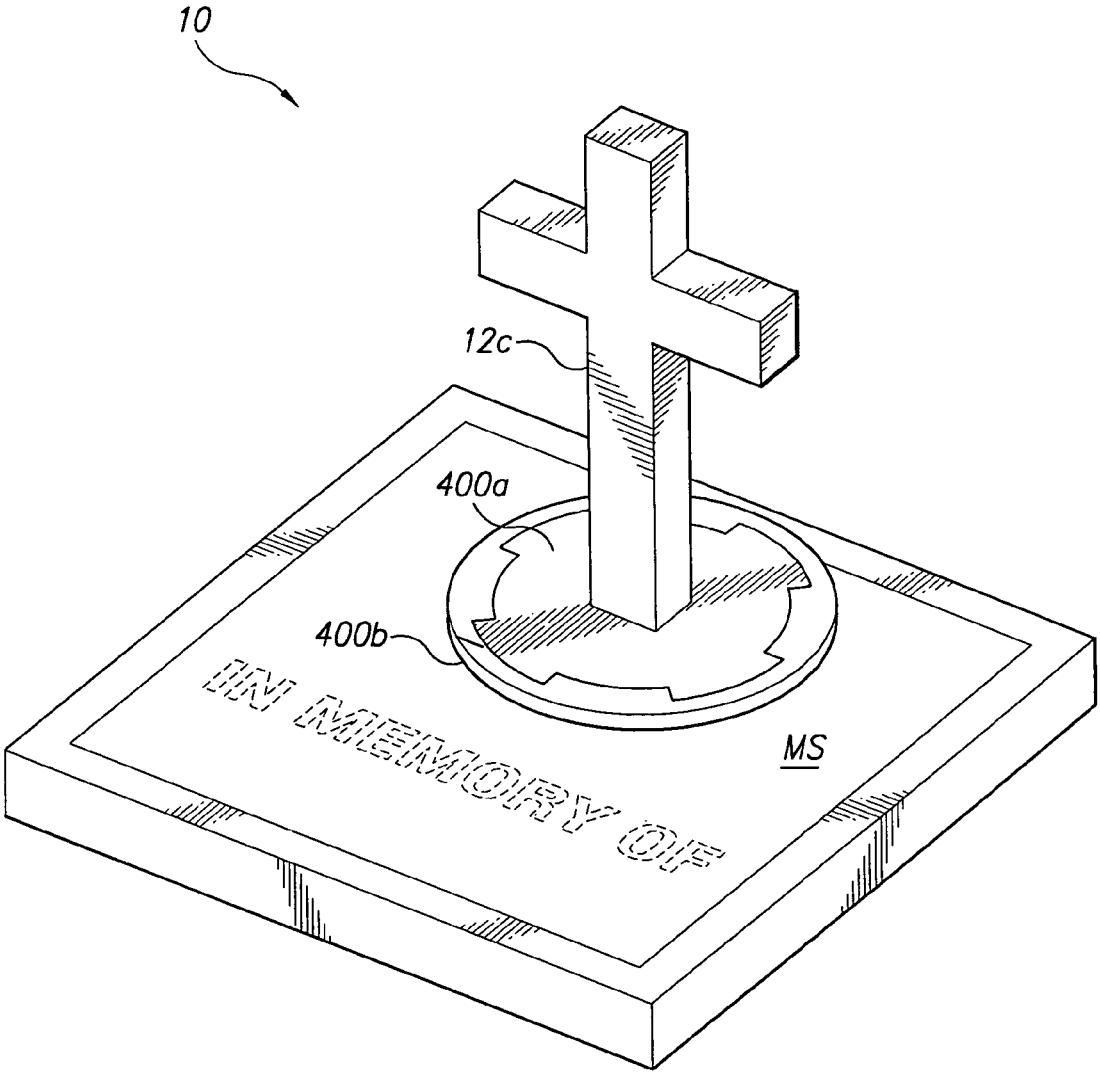
FIG. 5 is a perspective view of one of the funeral vase statues according to the present invention shown mounted to a monument stone via a mounting plate.

Alternatively, as shown in FIGS. 4-5, the vases 14 or figurines 12*c* may have bottom fastening members, such as a circular flange 400*a* having tabs 402 radially spaced about its periphery, for attachment to a monument stone MS equipped with a complementary fastening system, such as flange receptacle 400*b* having slots 404 complementary in shape to the tabs 402 and radially spaced projections 406 defining the slots 404 and a groove 408 beneath the projections 406. The tabs 402 may be aligned with the slots to insert the flange 400*a* into receptacle 400*a* and the flange 400*a* is rotated in the groove 408 to hook tabs 402 beneath the projections 406 to secure the statue or figurine 12*c* to the monument MS. The bottom fastening members 400*a* may be directly attached to or formed integrally with the base of the statue or figurine 12*c*.

A variety of statue/figurine designs are provided, and may include cultural and/or religious figures, symbols, and the like. The statues are designed to fit into multi-sized vases, which are typically mounted on stone or monuments or merely planted on gravesites. The statues or figurines can be made with various materials such as plastics, stone, pre-cast, or poly-resin but are not limited to these materials.

The funeral vase statues 10 come in a variety of sizes to accommodate the many different sizes of vases 14 offered, thereby allowing mounting on a ground plate, a vase 14, a monument plate, or the like. The statues or figurines can have many different colors, such as dye, stone, painted, or just natural color. The statues or figurines can be manufactured to fit the multi-size vases that are offered for typical uses, such as flower vases. Moreover, the statues/figurines are made to fit inside and be secured to vases 14 of a variety of sizes.

All embodiments of the funeral statue vases 10 can have solar or battery operated lighting 18 attached to a portion of the system, e.g., lighting panels 18 attached to vase 14. A protective grommet 300 is also used to keep water out of vase 14.

It is to be understood that the present invention is not limited to the embodiment described above, but encompasses any and all embodiments within the scope of the following claims.

I claim:

1. A funeral vase, comprising:

a vase defining an open container, the vase having a bottom and a flange member extending from the bottom, the flange member being adapted for mating to a complementary fastener on a monument stone to secure the vase to the monument stone;

a pre-cast member having a base and a mounting cylinder extending from the base, the mounting cylinder being slidable into the open container to support the pre-cast member above the vase, wherein said mounting cylinder has internally threaded bores defined therein and said vase has through-bores defined therein alignable with the threaded bores in said mounting cylinder; and fasteners cooperating with the internally threaded bores and the through-bores and removably securing the pre-cast member to the vase.

2. The funeral vase according to claim 1, wherein said fasteners comprising set screws threaded through the vase and into the internally threaded bores in said mounting cylinder.

3. The funeral vase according to claim 1, wherein said pre-cast member is a statue.

4. The funeral vase according to claim 1, wherein said pre-cast member is a figurine.

5. The funeral vase according to claim 1, further comprising a protective grommet disposed on the pre-cast member, said grommet contacting said vase, whereby fluids are kept out of said vase.

6. A funeral vase, comprising:

a vase defining an open container, the vase having a bottom and a flange member extending from the bottom, the flange member being adapted for mating to a complementary fastener on a monument stone to secure the vase to the monument stone;

a pre-cast member having a base and a mounting cylinder extending from the base, the mounting cylinder being slidable into the open container to support the pre-cast member above the vase;

a protective grommet disposed on the pre-cast member, said grommet contacting said vase, whereby fluids are kept out of said vase; and fasteners removably securing the pre-cast member to the vase.

7. A memorial display, comprising:

a vase, the vase defining an open container and having a top and a bottom and a flange member extending from the bottom, the flange member including a plurality of radially spaced tabs located about and extending from the periphery thereof;

a pre-cast member having a base and a mounting cylinder extending from the base, the mounting cylinder being slidable into the open container to support the pre-cast member above the vase, wherein the mounting cylinder has internally threaded bores defined therein and said vase has through-bores defined therein alignable with the threaded bores in said mounting cylinder, and fasteners cooperating with the internally threaded bores and the through-bores and removably securing the pre-cast member to the vase; and a monument stone including a flange receptacle therein, the flange receptacle comprising a complementary fastening system to accommodate the spaced tabs of the flange member, wherein the complementary fastening system includes a plurality of slots complementary in shape to the tabs and radially spaced projections defining the slots; and a groove beneath the projections, whereby the tabs are aligned with the slots to insert the flange member into the flange receptacle and the flange member is rotated in the groove to hook the tabs beneath the projections to secure the vase to the monument stone.

* * * * *